US006575413B1

(12) United States Patent
Straub

(10) Patent No.: US 6,575,413 B1
(45) Date of Patent: Jun. 10, 2003

(54) APPARATUS FOR PIVOTALLY SUPPORTING A LIQUID CONTAINER

(76) Inventor: John Straub, 9643 Russell St., Northville, MI (US) 48167

( * ) Notice: Subject to any disclaimer, the term of this patent is extended or adjusted under 35 U.S.C. 154(b) by 0 days.

(21) Appl. No.: 10/113,432

(22) Filed: Mar. 29, 2002

Related U.S. Application Data

(60) Provisional application No. 60/285,679, filed on Apr. 23, 2001.

(51) Int. Cl.[7] ..... A47F 5/12
(52) U.S. Cl. ..... 248/141
(58) Field of Search ..... 248/141, 311.2, 248/139, 140, 142, 224.61

(56) References Cited

U.S. PATENT DOCUMENTS

| | | | | | |
|---|---|---|---|---|---|
| 996,658 | A | * | 7/1911 | Minor | 248/142 |
| 1,755,745 | A | | 4/1930 | Parr | |
| 1,887,881 | A | * | 11/1932 | Blattner | 222/166 |
| 2,060,170 | A | | 11/1936 | Buck et al. | |
| 2,412,426 | A | * | 12/1946 | Rayko | 248/105 |
| 2,470,154 | A | | 5/1949 | Fitzgerald | |
| 2,554,875 | A | | 5/1951 | Okunami | |
| 2,745,616 | A | * | 5/1956 | Gomes | 248/138 |
| 2,807,430 | A | * | 9/1957 | Medlock | 248/106 |
| 2,817,458 | A | * | 12/1957 | Amigone | 222/131 |
| 2,948,499 | A | * | 8/1960 | Manny | 248/106 |
| 4,248,397 | A | * | 2/1981 | Casper | 248/138 |
| 4,317,551 | A | | 3/1982 | Bishop | |
| 4,437,636 | A | * | 3/1984 | Mazzurco et al. | 248/137 |
| D408,690 | S | * | 4/1999 | Lin | D7/621 |
| 5,890,686 | A | | 4/1999 | Morales | |
| 6,386,393 | B1 | * | 5/2002 | Paulovich et al. | 222/166 |

* cited by examiner

*Primary Examiner*—Leslie A. Braun
*Assistant Examiner*—Kofi Schulterbrandt
(74) *Attorney, Agent, or Firm*—Carrier, Blackman & Associates, P.C.; William D. Blackman; Joseph P. Carrier

(57) ABSTRACT

An apparatus for supporting a liquid container allows a user to easily pivot the container and pour liquid outwardly therefrom. The apparatus includes a base, a cradle pivotally supported on the base, and a stop member to limit return movement of the cradle on the base. The base includes two upstanding side braces interconnected by a web. The cradle includes a floor suspended and spaced upwardly away from the base web, and further includes two spaced apart cradle side portions extending upwardly from opposite side edges of the cradle floor. The cradle may also include a bridge interconnecting the tops of the side portions thereof, and where used, the bridge may include a bow formed integrally therein to receive a neck of a liquid container. The support apparatus may be adapted to receive a standard gallon jug, or alternatively, may be adapted to receive a two-liter beverage bottle.

15 Claims, 6 Drawing Sheets

APPARATUS FOR PIVOTALLY SUPPORTING A LIQUID CONTAINER

BACKGROUND OF THE INVENTION

1. Field of the Invention

The present invention relates to a support frame apparatus for holding and pivotally supporting a liquid container. More particularly, the present invention relates to a support frame apparatus including a base and a cradle, which is pivotally attached to the base. The apparatus is provided to supportively receive a liquid container therein, and to allow controlled and balanced tipping of the liquid container, so that a liquid may be poured therefrom.

2. Description of the Background Art

Many different types of fluids, and particularly beverages such as milk and juices, are commonly sold in flexible plastic gallon jugs. These gallon jugs may be cumbersome for children or for frail persons to handle unaided, especially when they are full.

The same problem may arise with two-liter beverage bottles. While these types of bottles have become de-facto industry standards today, the two-liter bottles are bulky and cumbersome to handle, particularly for young or frail persons, and most notably when the bottles are full.

In addition, both of these types of liquid containers are especially difficult to control when a user is trying to pour using only one hand.

A number of different devices are known for supportively holding a container while allowing for pivotal movement of the container.

Examples of some of the known devices include U.S. Pat. No. 1,755,745 to Parr, U.S. Pat. No. 1,887,881 to Blattner, U.S. Pat. No. 2,060,170 to Buck, U.S. Pat. No. 2,470,154 to Fitzgerald, U.S. Pat. No. 2,554,875 to Okunami, U.S. Pat. No. 4,317,551 to Bishop, and U.S. Pat. No. 5,890,686 to Morales.

Although the known devices have some utility for their intended purposes, a need still exists in the art for an improved support frame apparatus for enabling a user to easily control and pour from a liquid container.

In particular, there is a need for an improved support frame apparatus which will enable a user to easily control and pour fluid from a plastic gallon jug of the type which is commonly used for milk, juices and the like today, and which will support most of the weight of the jug, while allowing a user to easily pour a liquid therefrom in a controlled manner.

This familiar standardized gallon-capacity jug, shown at 100 in FIG. 2, has a substantially box-shaped lower section with rounded corners, and tapers inwardly at the top part thereof to form a narrow neck, with an integral handle connecting the neck to the body of the jug.

There is also a need for an improved support frame apparatus which will enable a user to easily pour fluid in a controlled manner from a two-liter beverage bottle.

SUMMARY OF THE INVENTION

The present invention provides an apparatus for supportively holding a liquid container, while allowing a user to easily pivot the container to pour liquid therefrom. The apparatus supports most of the weight of the container, freeing the user from the burden of supporting the container during pouring.

If desired, the apparatus hereof may easily be stored in a refrigerator, with a milk jug or other fluid container stored therein.

A support apparatus according to the present invention includes a base and a cradle which may be pivotally supported on the base.

The base includes two upstanding side braces interconnected by a web. Preferably, the side braces are substantially vertically oriented, and the web is flat for placement on a surface such as a tabletop or counter.

The cradle is provided for supportively receiving a liquid container, and for moving with the container as it is tilted to pour liquid therefrom. The cradle is pivotally attachable to the base, as noted. The cradle includes a cradle floor for supporting the liquid container thereon.

The cradle floor is preferred to be spaced upwardly away from the web portion of the base, to minimize the chance that a user of the apparatus may accidentally get one or more fingers pinched between the cradle and the base.

The cradle also includes two spaced apart side portions, extending upwardly from opposite side edges of the cradle floor.

A connection bar may be provided for interconnecting the side portions to strengthen and reinforce the cradle structure, and where used, the connection bar extends above the cradle floor. The connection bar may be integral with the cradle floor and extend upwardly therefrom, or alternatively, the connection bar may be spaced upwardly away from the cradle floor. The connection bar also functions to limit forward travel of the fluid container in the cradle.

In a particular embodiment, the cradle further includes a stop member, for contacting the base to limit return movement of the cradle with respect thereto. Preferably, the stop member is attached to one or both of the cradle side portions or to the cradle floor.

In one illustrative embodiment of the support apparatus, each of the cradle side portions has a post attached thereto and extending outwardly thereon, and each of the side braces of the base has a recess formed therein to receive one of the cradle posts. The posts of the cradle fit into the recesses in the base side braces, permitting the cradle to be pivotally moved on the base.

The recesses may, optionally, be substantially V-shaped and open upwardly, so that the cradle may easily be lifted off the base.

Alternatively, each of the base side braces may have a post attached thereto and extending inwardly thereon, and each of the cradle side portions may have a hole formed in an outer surface thereof to receive one of the posts.

In one embodiment of the invention, the stop member includes two side flanges which extend laterally outwardly beyond the cradle side portions, for contacting each of the base side braces to limit movement of the cradle.

In another embodiment of the invention, the base side braces may have hollow pockets formed therein to receive the stop members, allowing the stop members to fit flush with the base edges.

The cradle may also include a bridge, reinforcingly interconnecting the two side portions above the connection bar. Where used, the bridge may include an arcuate bow formed integrally therein to supportively receive a neck of the liquid container. Preferably, the inner surface of the bridge bow is tapered to receive a tapered neck of a fluid container.

Accordingly, it is an object of the present invention to provide a method and apparatus for pivotally supporting a liquid container, to allow a user to easily pour liquid out of the container with good control and without great exertion.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

The present invention provides an apparatus for supporting a liquid container, while allowing a user to easily pivot the container to pour liquid therefrom.

First Preferred Embodiment

Figure 1:
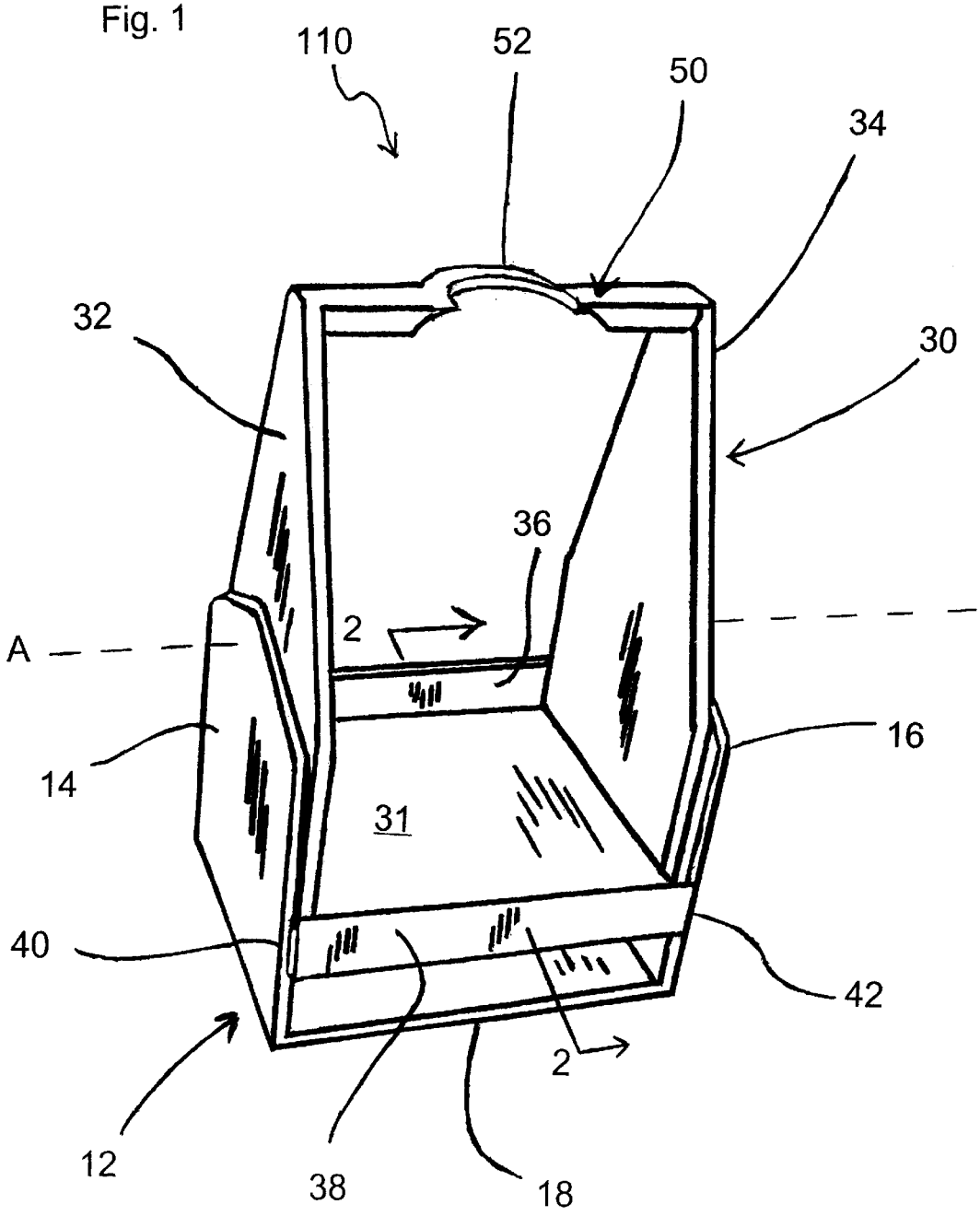
FIG. 1 is a perspective view of a support apparatus in accordance with a first preferred embodiment of the present invention, shown in a resting position thereof.
Figure 2:
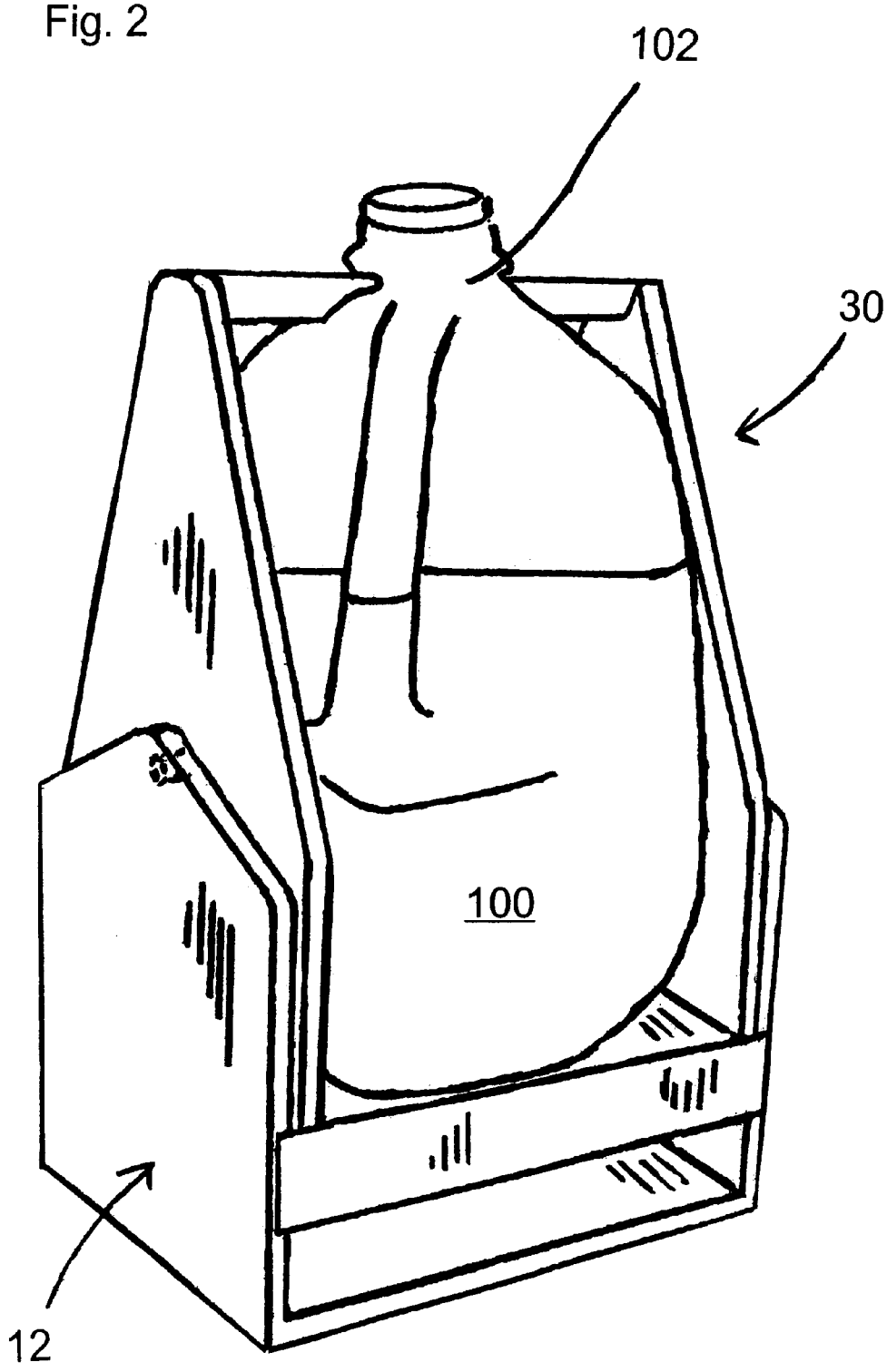
FIG. 2 is a perspective view of the apparatus of FIG. 1, shown in the resting position and also showing a liquid container supported in the cradle thereof.
Figure 3:
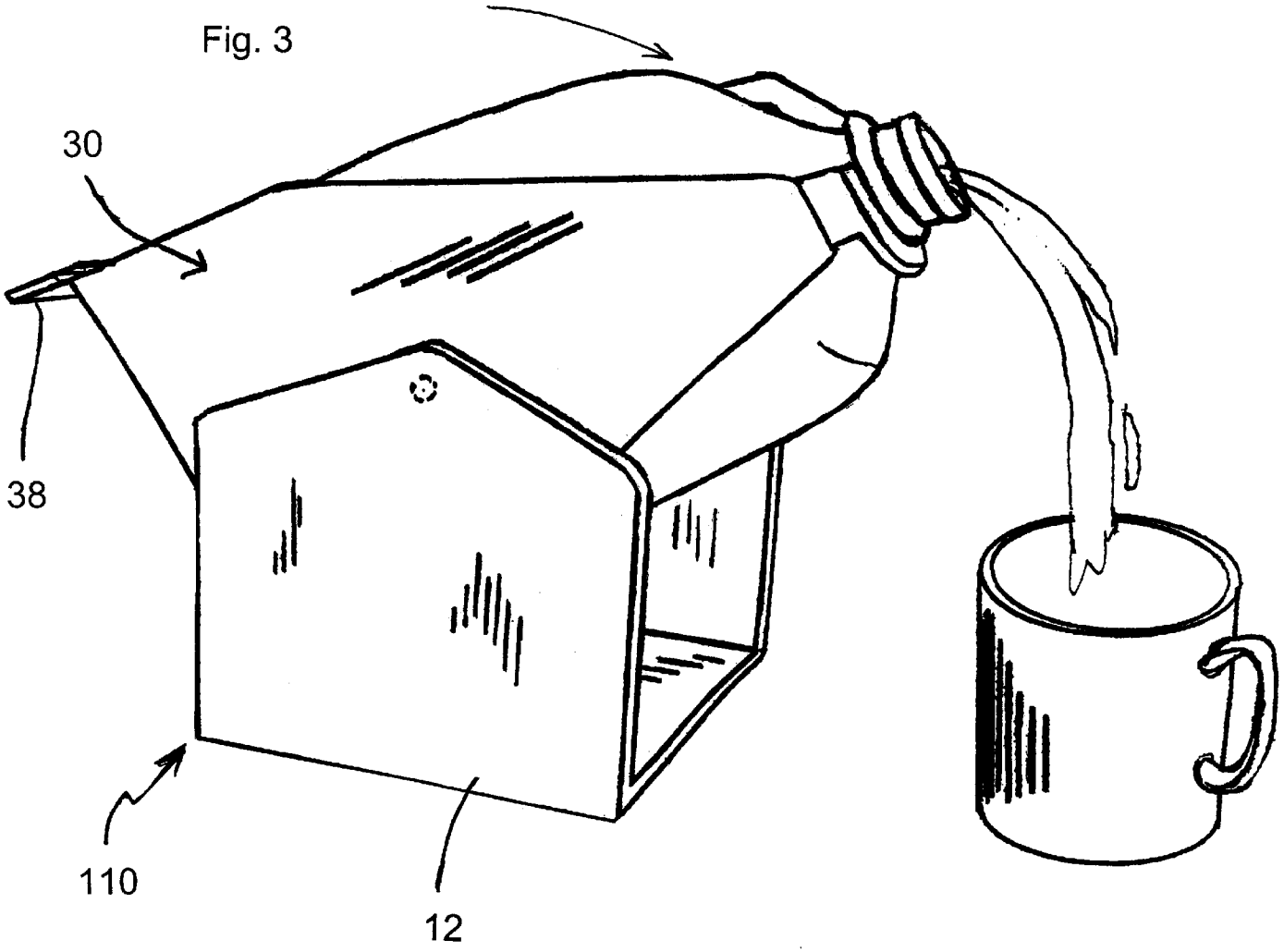
FIG. 3 is a perspective view of the support apparatus of FIGS. 1–2, showing the apparatus in its pouring position and showing liquid being poured out of the liquid container and into a drinking vessel.

Referring now to FIGS. 1–3 of the drawings, a support apparatus according to a first preferred embodiment of the present invention is shown generally at 110. The apparatus 110 includes a base 12 and a cradle 30, which is pivotally supported on the base.

The Base (1$^{st}$ Embodiment)

The base 12 is substantially U-shaped as seen from the front, and includes two upstanding side braces 14, 16 interconnected by a web 18. The base 12 may be formed of solid material. Alternatively, the base may be foraminous, may be formed as a grid, or may be made as a wire frame.

The web 18 is generally made flat for placement on a correspondingly flat support surface (not shown), such as a tabletop, refrigerator shelf, or counter.

Preferably, in the embodiment of FIGS. 1–4, the side braces 14, 16 are substantially vertically oriented, and are substantially perpendicular to the web 18.

Figure 4:
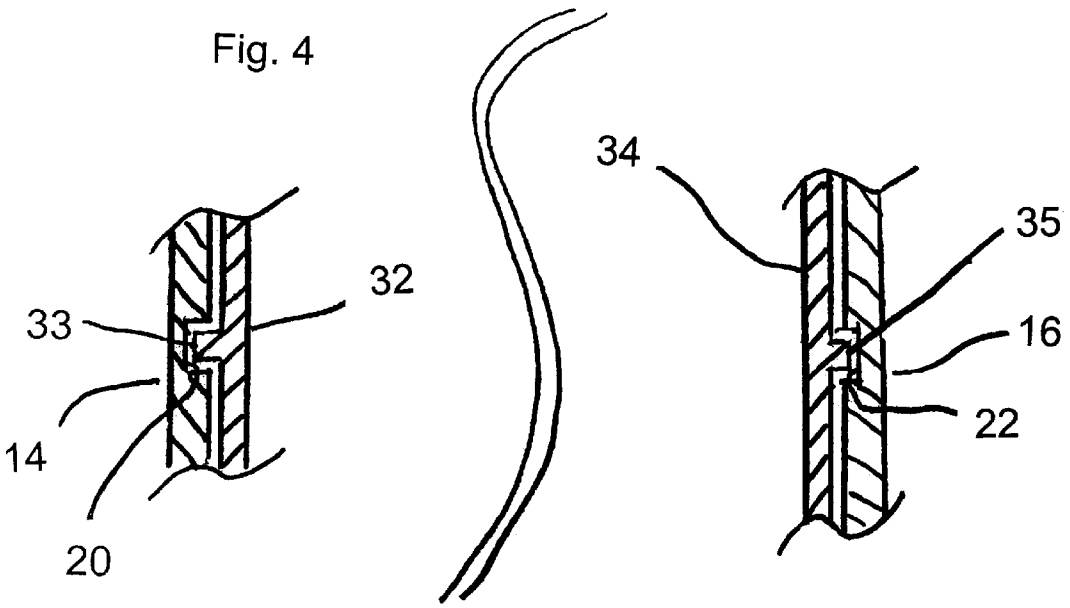
FIG. 4 is a medial cross-section, partially broken away, of the apparatus of FIG. 1, showing the pivotal connection between the base and cradle thereof.
Figure 6:
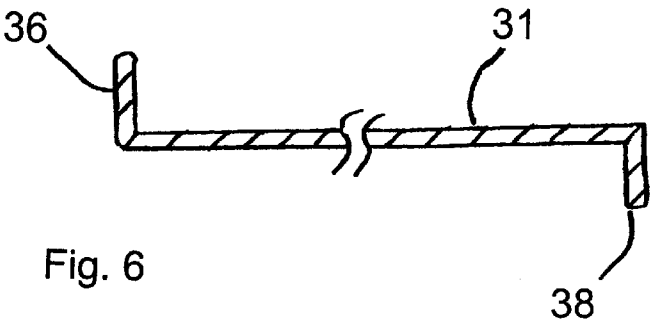
FIG. 6 is a cross-section of a cradle, which is a component of the apparatus of FIG. 1, taken along the line 2—2 FIG. 1.

As seen in FIG. 4, preferably, the side braces 14, 16 of the base 12 have recesses 20, 22 formed in the respective inwardly facing surfaces thereof, to receive pivot posts 33, 35 of the cradle side walls 32, 34 therein.

Those in the art will realize that this arrangement could be reversed, and the posts could just as well be on the base side braces, while the recesses were formed in the cradle side walls. Either way, the cradle 30 is supported by the base 12, so as to be pivotally movable thereon about a horizontal axis A.

Figure 5A:
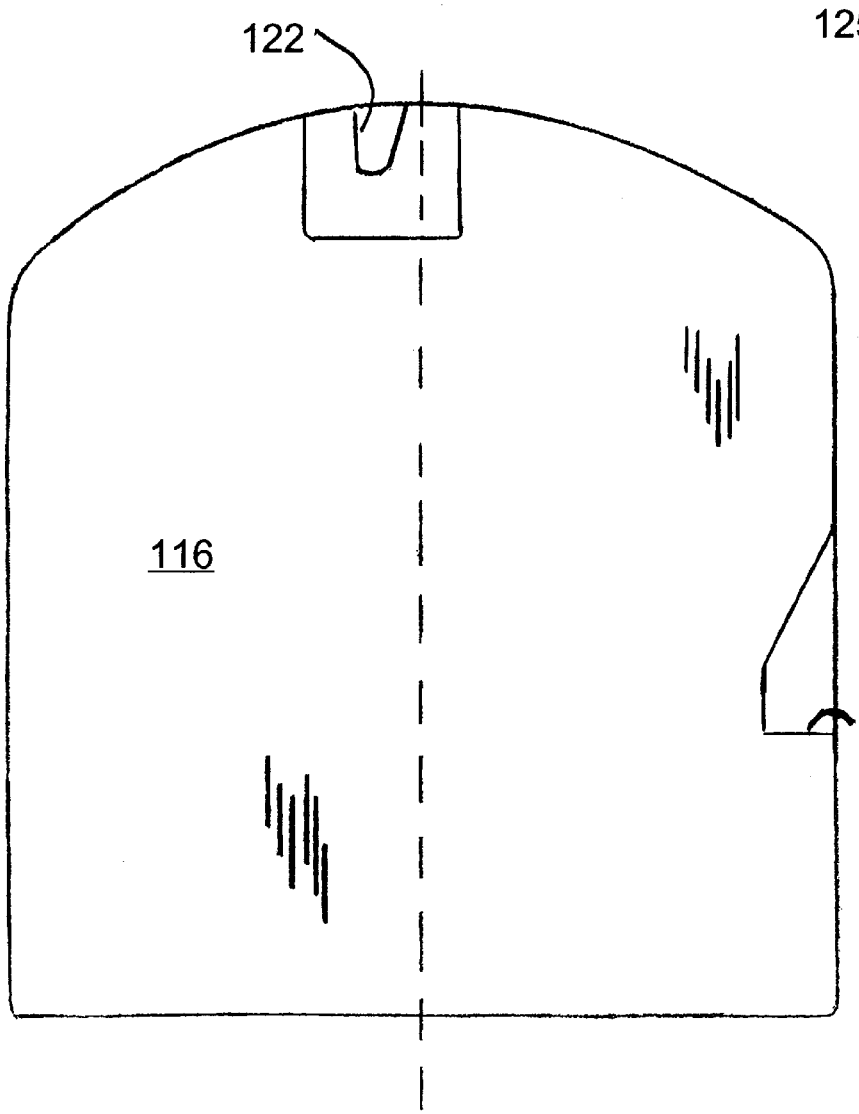
FIG. 5A is a side plan view of a side brace portion of the base of the apparatus hereof.
Figure 5B:
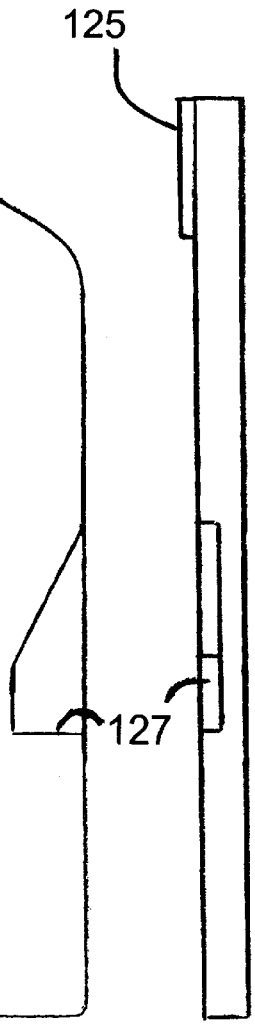
FIG. 5B is an end plan view of the side brace of FIG. 5A.

Referring now to FIGS. 5A–5B, a variation on the base of the first embodiment is shown. FIG. 5 is a plan view of the inner surface of one of the base side braces 116. A vertical centerline of the side brace is shown in the drawing, in a dashed line, for reference purposes.

In the embodiment of FIG. 5A, the recess 122 of the side member is substantially V-shaped, and is open at the top. This allows the cradle 30 to easily be lifted off of, and separated from the base 12 for cleaning, repair, or other purposes. It also allows the cradle to move upwardly, as the cradle returns to its upright resting position, if anything becomes caught between the cradle 30 and the base 12.

Further in this modified embodiment, as shown in FIG. 5B, the portion of the brace in the area of the recess is thicker than the rest of the brace, forming a spacer 125, to minimize the area of physical contact between the cradle and the brace. The presence of the spacer 125 promotes and facilitates pivotal movement of the cradle relative to the brace.

A third feature of this modified embodiment is that the side brace 116 has a hollow pocket 127 formed therein, as shown, to receive a stop member of the cradle 30.

The Cradle (1$^{st}$ Embodiment)

The cradle 30 is provided for supportively receiving a liquid container, such as that shown at 100 (FIG. 2), therein. The support apparatus 110 in the embodiment of FIGS. 1–4 is particularly adapted, constructed and arranged to receive and support a one-gallon plastic jug, of the type in which milk is commonly sold.

The cradle 30 is pivotally attached to the base 12, as noted. The cradle 30 includes a cradle floor 31 for supporting the liquid container 100 thereon. The cradle may be solid, may be a foraminous plastic grid, or may be formed of wire.

The cradle floor 31 is preferred to be spaced upwardly, away from the web portion 18 of the base 12, to reduce the likelihood that a user of the apparatus may accidentally get one or more fingers pinched between the cradle 30 and the base 12.

The cradle 30 also includes two spaced apart cradle side portions 32, 34 (FIG. 1), extending upwardly from opposite side edges of the cradle floor 31.

A horizontal connection bar 36 may be provided for interconnecting the cradle side portions 32, 34, above the cradle floor 31 to strengthen and reinforce the cradle structure. The connection bar 36 may be integral with the cradle floor 31, as shown, and extend upwardly therefrom. Alternatively, the connection bar may be spaced away from the cradle floor, such as being placed between shoulder portions of the cradle side portions 32, 34. Another alternative to the use of the connection bar 36 is to simply include a flange (not shown), which does not extend the full width of the cradle, extending upwardly from the front of the cradle floor, to limit the forward travel of the base portion of a liquid container 100 in the cradle.

In the embodiment of FIGS. 1–4, as noted above and as illustrated in FIG. 4, each of the cradle side portions 32, 34 has a respective post 33, 35 attached thereto and extending outwardly thereon. The posts fit rotatably within the recesses 20, 22 in the side braces 14, 16 of the base 12, permitting the cradle 30 to be pivotally moved on the base 12.

Preferably, the posts 33, 35 are located away from the vertical center of the side braces 14, 16 to make the cradle 30 predisposed to return to its resting position under the influence of gravity, as illustrated in FIG. 1.

In the depicted embodiment of FIGS. 1–4, the stop member 38 includes two side flanges 40, 42 for contacting each of the base side braces 14, 16.

The two side flanges 40, 42 extend laterally outwardly beyond the cradle side portions 32, 34, to contact the base 12.

The apparatus 110 hereof is also preferred to include a stop member to limit pivotal travel of the cradle 30 on the base 12. The stop member may be attached to one or both of the side portions 32, 34, or may be attached to the bottom of the cradle floor 31. Alternatively, instead of being part of the cradle 30, the stop member 38 may be part of the base 12, such as, for example, extending upwardly from the web 18 thereof.

In the embodiment of FIGS. 1–4, the stop member 38 is provided as dual flanges which extend laterally outwardly on opposite sides of the cradle at the rear edge thereof, for contacting the base 12, and for limiting return movement of the cradle with respect thereto. When the modified base of FIGS. 5A–5B is used, the stop member flanges may be configured to fit within the hollow pockets 127 formed in the base side braces.

As shown in the drawings, the cradle 30 may also include a bridge 50 at the top end thereof, reinforcingly interconnecting the two side portions 32, 34 above the connection bar 36. In the embodiment of FIGS. 1–4, the bridge 50 interconnects the upper ends of the side portions. Where used, the bridge 50 may include an arcuate bow 52, formed integrally therein, to supportively receive a neck 102 of the liquid container 100.

In the embodiment of FIGS. 1–4, the bridge 50 may be tapered in the area of the bow 52, from a narrow opening at the top thereof to a wider opening at the bottom, to correspondingly conform to the tapered shape of the neck portion of a liquid container 100.

Second Preferred Embodiment

Figure 7:
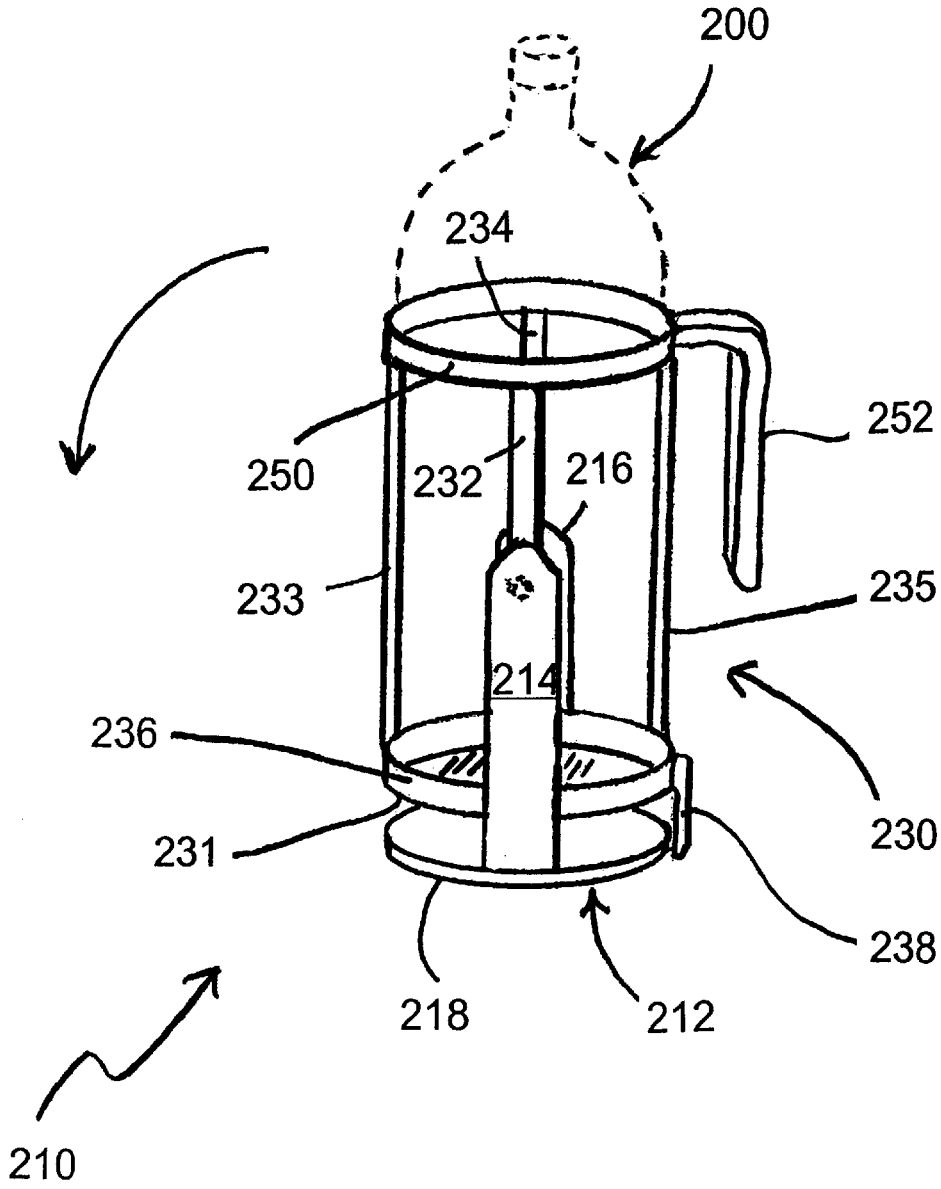
FIG. 7 is a perspective view of a support apparatus in accordance with a second embodiment of the invention, showing a liquid container in phantom therein.

Referring now to FIG. 7, a support apparatus in accordance with a second embodiment of the invention is shown at 210 in FIG. 7. The apparatus 210 is especially adapted to supportively receive a liquid container 200 having a two-liter capacity, and of a type which is commonly used to hold carbonated beverages.

The apparatus 210 includes a base 212 and a cradle 230, which is pivotally supported on the base.

The Base ($2^{nd}$ Embodiment)

The base 212 is formed in a square U-shape, as seen from the front, and includes two upstanding side braces 214, 216 interconnected by a web 218. The base 212 may be formed of solid material, or may be foraminous, formed as a grid, or made as a wire frame.

The web 218 is generally formed as a flat disc for placement on a correspondingly flat support surface (not shown), such as a tabletop or counter.

Preferably, in the embodiment of FIG. 7, the side braces 214, 216 are thin bands, which are substantially vertically oriented, and are substantially perpendicular to the web 218.

The side braces 214, 216 of the base 212 may have recesses formed in the respective inwardly facing surfaces thereof, to receive pivot posts of the cradle side walls 232, 234 therein, in a manner analogous to that shown in FIG. 4 and discussed above in connection with the first embodiment 110.

The Cradle ($2^{nd}$ Embodiment)

The cradle 230 is provided for supportively receiving a liquid container 200 therein. The support apparatus 210 in the embodiment of FIG. 7 is particularly adapted, constructed and arranged to receive and support a two-liter plastic bottle, of the type in which beverages are commonly sold.

The cradle 230 is pivotally attached to the base 212, as noted. The cradle 230 includes a cradle floor 231 for supporting the liquid container 200 thereon.

The cradle floor 231 is spaced upwardly away from the web portion 218 of the base 212, to reduce the likelihood that a user of the apparatus may accidentally get one or more fingers pinched between the cradle 230 and the base 212.

The cradle 230 also includes two spaced apart side portions 232, 234, extending upwardly from opposite side edges of the cradle floor 231.

A horizontal connection bar 236 is provided for interconnecting the cradle side portions 232, 234, above the cradle floor 231 to strengthen and reinforce the cradle structure. The connection bar 236 may be integral with the cradle floor 231, as shown, and extend upwardly therefrom. Alternatively, the connection bar may be spaced away from the cradle floor, such as being placed between shoulder portions of the cradle side portions 232, 234.

The cradle 230 further includes a stop member 238, for contacting the base 212 to limit return movement of the cradle with respect thereto. The stop member 238 may be attached to one or both of the side portions 232, 234, to the connecting bar 236, as shown, or to the bottom of the cradle floor 231. Alternatively, instead of being part of the cradle 230, the stop member 238 may be part of the base 212, such as, for example, extending upwardly from the web 218 thereof.

In the depicted embodiment of FIG. 7, the stop member 238 vertically downwardly at the back of the cradle floor 231, for contacting an outer edge of the web 218.

Also in the embodiment 210 of FIG. 7, the cradle 230 includes a collar 250 at the top thereof, and a pair of opposed vertical stays 233, 235 to form a cage-like structure.

Still further in the second embodiment 210 hereof, the cage includes a handle 252, integrally attached to and extending downwardly from the collar 250. The handle 252 is provided to allow a user of the apparatus to easily manipulate the cradle and control pouring from a bottle 200 held therein.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

I claim:

1. An apparatus for supportively holding a liquid container, said apparatus comprising:

a base comprising two upstanding side braces interconnected by a web; and a cradle for supportively receiving a liquid container, the cradle being pivotally supportable on the base and comprising:

a cradle floor for supporting said liquid container thereon, said cradle floor having two opposite side edges;

two cradle side portions, one of said cradle side portions extending upwardly from each of the side edges of the cradle floor;

a bridge interconnecting said cradle side portions and having an arcuate cutout formed integrally therein to receive a neck of said liquid container; a portion of the bridge surrounding the cutout being tapered outwardly, from a narrow portion at the top of the bridge to a wider portion at the bottom of the bridge, to accommodate a tapered container neck; and a stop member attached to the cradle or to the base, for limiting return movement of the cradle with respect to the base;

wherein the cradle is supportably mountable on the base in a manner such that it may be moved from a resting position, in which the cradle floor is substantially horizontal, to a pivotally tilted position;

and further wherein the weight distribution of the cradle on the base, when it is mounted thereon, biases the cradle toward the resting position thereof.

2. The apparatus of claim 1, wherein each of the cradle side portions has a post attached thereto and extending outwardly thereon, and further wherein each of the side braces of the base has a recess formed therein to supportively receive one of the cradle posts, whereby the cradle may be pivotally moved on the base.

3. The apparatus of claim 2, wherein each of the side brace recesses has a substantially V-shaped outline.

4. An apparatus for supportively holding a liquid container, said apparatus comprising:

a base comprising two upstanding side braces interconnected by a web; and a cradle for supportively receiving a liquid container, the cradle being pivotally supportable on the base and comprising:

a cradle floor for supporting said liquid container thereon, said cradle floor having two opposite side edges;

two cradle side portions, one of said cradle side portions extending upwardly from each of the side edges of the cradle floor; and a stop member attached to the cradle or to the base, for limiting return movement of the cradle with respect to the base, wherein the stop member comprises at least one flange which extends outwardly on a selected cradle side portion, for contacting the base;

wherein the cradle is supportably mountable on the base in a manner such that it may be moved from a resting position, in which the cradle floor is substantially horizontal, to a pivotally tilted position;

and further wherein the weight distribution of the cradle on the base, when it is mounted thereon, biases the cradle toward the resting position thereof.

5. The apparatus of claim 1, wherein each of a first set of parts, selected from the group consisting of the cradle side portions and the base side braces, has a post attached thereto and extending therefrom, and wherein each of a second set of parts, selected from the group consisting of the cradle side portions and the base side braces, has a hole formed therein to receive one of said posts, whereby the cradle may be pivotally moved on the base.

6. An apparatus for supportively holding a liquid container, comprising:

a base, comprising two upstanding side braces interconnected by a web; and a cradle for supportively receiving a liquid container, the cradle being pivotally attached to the base and comprising:

a cradle floor for supporting said liquid container thereon, said cradle floor having two opposed side edges;

two cradle side portions, one of said cradle side portions extending upwardly from each of the side edges of the cradle floor;

a bridge interconnecting the upper ends of the cradle side portions and having an arcuate cutout formed therein to receive a bottle neck; and a stop member attached to the cradle, for limiting return movement of the cradle with respect to the base;

wherein the cradle is supportably mountable on the base in a manner such that it may be moved from a resting position, in which the cradle floor is substantially horizontal, to a pivotally tilted position;

and further wherein the base has a hollow pocket formed therein to receive the stop member when the cradle is in its resting position.

7. The apparatus of claim 6, wherein the portion of the bridge surrounding the cutout tapers outwardly, from a narrow portion at the top of the bridge to a wider portion at the bottom of the bridge, to accommodate a tapered container neck.

8. The apparatus of claim 6, wherein each of a first set of parts, selected from the group consisting of the cradle side portions and the base side braces, has a post attached thereto and extending therefrom, and wherein each of a second set of parts, selected from the group consisting of the cradle side portions and the base side braces, has a hole formed therein to receive one of said posts, whereby the cradle may be pivotally moved on the base.

9. An apparatus for supportively holding a liquid container, said apparatus comprising:

a base comprising two upstanding side braces interconnected by a web, each of the side braces having a substantially V-shaped recess formed in an inwardly facing surface thereof; and a cradle for supportively receiving a liquid container, the cradle being pivotally supportable on the base and comprising:

a cradle floor for supporting said liquid container thereon, said cradle floor having two opposite side edges;

two cradle side portions, one of said cradle side portions extending upwardly from each of the side edges of the cradle floor;

each of the cradle side portions having a cylindrical pin extending outwardly from an upper end thereof for placement in one of the recesses of the base; and a stop member attached to the cradle or to the base, for limiting return movement of the cradle with respect to the base;

wherein the cradle is supportably mountable on the base in a manner such that it may be moved from a resting position, in which the cradle floor is substantially horizontal, to a pivotally tilted position.

10. The apparatus of claim 9, wherein the cradle further comprises a bridge reinforcingly interconnecting the upper ends of the two side portions.

11. The apparatus of claim 10, wherein the bridge has an arcuate cutout formed integrally therein to receive a neck of said liquid container.

12. The apparatus of claim 11, wherein the portion of the bridge surrounding the cutout tapers outwardly, from a narrow portion at the top of the bridge to a wider portion at the bottom of the bridge, to accommodate a tapered container neck.

13. The apparatus of claim 9, wherein each of the cradle side portions comprises a panel having a vertical center line, and wherein the recess in the side portion is spaced laterally away from the center line thereof, in order to bias the cradle toward its resting position when it is mounted on the base.

14. The apparatus of claim 9, wherein the stop member is formed as part of the cradle, and extends outwardly thereon;

and further wherein the base has a hollow pocket formed therein to receive the stop member when the cradle is in its resting position.

15. An apparatus for supportively holding a liquid container, said apparatus comprising:

a base comprising two upstanding side braces interconnected by a web; and a cradle for supportively receiving a liquid container, the cradle being pivotally supportable on the base and comprising:

a cradle floor for supporting said liquid container thereon, said cradle floor having two opposite side edges;

two cradle side portions, one of said cradle side portions extending upwardly from each of the side edges of the cradle floor; and a stop member attached to the cradle for limiting return movement of the cradle with respect to the base;

wherein the cradle is supportably mountable on the base in a manner such that it may be moved from a resting position, in which the cradle floor is substantially horizontal, to a pivotally tilted position;

and further wherein the base has a hollow pocket formed therein to receive the stop member when the cradle is in its resting position.

* * * * *